US010662973B2

(12) United States Patent
Yamazaki

(10) Patent No.: US 10,662,973 B2
(45) Date of Patent: May 26, 2020

(54) REVERSIBLE FLOW FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 144 days.

(21) Appl. No.: 15/716,018

(22) Filed: Sep. 26, 2017

(65) Prior Publication Data

US 2018/0087439 A1 Mar. 29, 2018

(30) Foreign Application Priority Data

Sep. 29, 2016 (JP) ..... 2016-191950

(51) Int. Cl.

*F04D 29/38* (2006.01)
*F04D 19/00* (2006.01)
*F04D 29/66* (2006.01)

(52) U.S. Cl.

CPC ..... *F04D 29/384* (2013.01); *F04D 19/005* (2013.01); *F04D 29/667* (2013.01); *F05D 2240/301* (2013.01); *F05D 2240/307* (2013.01)

(58) Field of Classification Search

CPC .... F04D 29/384; F04D 29/541; F04D 29/667; F04D 19/005; H05K 7/20145; F01P 5/043

See application file for complete search history.

(56) References Cited

U.S. PATENT DOCUMENTS

| | | | |
|---|---|---|---|
| 5,616,004 A | 4/1997 | Alizadeh | |
| 2006/0257254 A1 | 11/2006 | Ho et al. | |
| 2015/0176597 A1 | 6/2015 | Tadokoro et al. | |
| 2016/0003487 A1 | 1/2016 | Iwase | |

FOREIGN PATENT DOCUMENTS

| | | | |
|---|---|---|---|
| EP | 3043077 A1 | 7/2016 | |
| JP | 10-501867 A | 2/1998 | |
| JP | 2006-316787 | 11/2006 | |
| JP | 2008045442 A | 2/2008 | |
| JP | 2009-97430 A | 5/2009 | |
| WO | 2014024654 A1 | 2/2014 | |
| WO | WO-2016071948 A1 * | 5/2016 | ..... F04D 29/384 |
| WO | 2015/030048 A1 | 3/2017 | |

OTHER PUBLICATIONS

WO-2016071948-A1 Machine Translation. Accessed EPO website on Sep. 17, 2019. 14 Pages. (Year: 2019).*
Office Action dated Apr. 11, 2018 for the corresponding Philippine Patent Application No. 1-2017-000258.
European search report dated Feb. 21, 2018 for the corresponding European Patent Application No. 17193943.2.
Japanese Office Action (JPOA) dated Mar. 17, 2020 for the corresponding Japanese Patent Application No. 2016-191950.

* cited by examiner

*Primary Examiner* — Richard A Edgar
(74) *Attorney, Agent, or Firm* — Rankin, Hill & Clark LLP

(57) ABSTRACT

A reversible flow fan includes: an impeller that includes blade portions; and rear-edge curved portions disposed on surfaces on rear edge sides of the blade portions in a normal rotation direction of the impeller. The rear-edge curved portions are convexly curved from a center of the impeller toward directions of outer peripheral portions of the blade portions in airflow directions during a reverse rotation of the impeller.

4 Claims, 10 Drawing Sheets

REVERSIBLE FLOW FAN

CROSS-REFERENCE TO RELATED APPLICATION

This application claims priority from Japanese Patent Application No. 2016-191950 filed with the Japan Patent Office on Sep. 29, 2016, the entire content of which is hereby incorporated by reference.

BACKGROUND

1. Technical Field

This disclosure relates to a reversible flow fan.

2. Description of the Related Art

A blast fan is an apparatus that generates an airflow to be used for cooling, for example, an electronic component. Performance of the blast fan depends on a capacity for causing the airflow to pass through. As the capacity for causing the airflow to pass through is increased, a noise tends to increase. In view of this, various devices are provided for achieving both the performance as the blast fan and the noise reduction.

Japanese Unexamined Patent Application Publication No. 2006-316787 discloses a technique relating the devices. The technique has an object to provide a heat radiation fan, a fan frame structure of the heat radiation fan, and a heat radiation system. The heat radiation fan has a smoothly curved enlarged portion. The curved enlarged portion is configured to reduce a noise generated by a friction of an airflow and a frame wall portion of the fan frame. Then, the curved enlarged portion is configured to ensure stabilization and concentration of the airflow to enhance the performance. The fan frame structure of the heat radiation device disclosed in this literature includes a pillar-shaped passage 216 that guides the airflow from one opening to the other opening. Furthermore, the pillar-shaped passage 216 disposed on the at least one opening side has an inner peripheral wall that has a smoothly curved enlarged portion F. The curved enlarged portion F expands in a radial direction and outward (see ABSTRACT).

SUMMARY

A reversible flow fan includes: an impeller that includes blade portions; and rear-edge curved portions disposed on surfaces on rear edge sides of the blade portions in a normal rotation direction of the impeller. The rear-edge curved portions are convexly curved from a center of the impeller toward directions of outer peripheral portions of the blade portions in airflow directions during a reverse rotation of the impeller.

DESCRIPTION OF THE EMBODIMENTS

Figure 1:
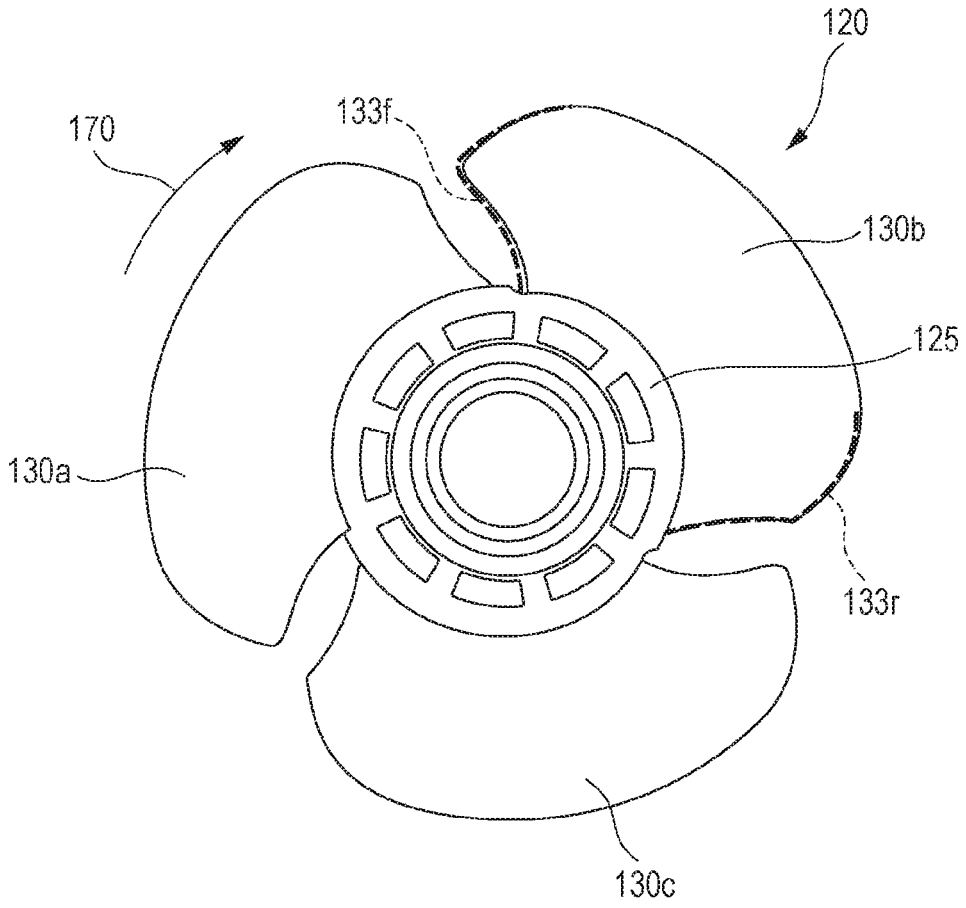
FIG. 1 is a front view illustrating an exemplary configuration of an impeller (vane) used for a blast fan according to a first embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Blast fans include a type referred to such as a reversible flow fan. The fan of this type is configured to rotate a motor in two directions of a normal rotation (a fluid moves to a back surface side) and a reverse rotation (the fluid moves to a front surface side) so as to use both airflows in the two directions. It is sometimes necessary for the reversible flow fan to equivalently have performance during the normal rotation and performance during the reverse rotation. Similarly, it is sometimes preferred that noise characteristics during the normal rotation and noise characteristics during the reverse rotation are equivalent.

The technique disclosed in above Japanese Unexamined Patent Application Publication No. 2006-316787 is to reduce noise. However, the technique seems not to assume the motor rotations in the two directions of the normal rotation and the reverse rotation. Accordingly, it is considered that the technique disclosed in the document has difficulty in reducing the noise characteristics during the reverse rotation of the reversible flow fan.

It is one object of this disclosure to reduce the noise characteristics during the reverse rotation of the reversible flow fan. It is another object of this disclosure to make the noise characteristics during the normal rotation and the noise characteristics during the reverse rotation close to one another.

A reversible flow fan according to an aspect of the present disclosure includes: an impeller that includes blade portions; and rear-edge curved portions disposed on surfaces on rear edge sides of the blade portions in a normal rotation direction of the impeller. The rear-edge curved portions are convexly curved from a center of the impeller toward directions of outer peripheral portions of the blade portions in airflow directions during a reverse rotation of the impeller.

The rear-edge curved portion may have an inflection point of the rear edge as a position where a curvature of the rear-edge curved portion varies, and the inflection point may be positioned on a position apart from the center of the impeller by 70% to 90% of a length from the center of the impeller to the outer peripheral portion of the blade portion.

An inclined angle of the rear-edge curved portion in a direction of the impeller center with respect to the inflection point may be in a range of −5° to +5°, and an inclined angle of the rear-edge curved portion in a direction of the outer peripheral portion of the impeller with respect to the inflection point may be in a range of +15° to +30°.

A reversible flow fan according to another aspect of the present embodiment includes: an impeller that includes blade portions; and front-edge curved portions disposed on surfaces on front edge sides of the blade portions in a normal rotation direction of the impeller. The front-edge curved portions are concavely curved from a center of the impeller toward directions of outer peripheral portions of the blade portions in airflow directions during a reverse rotation of the impeller.

The front-edge curved portion may have an inflection point of the front edge as a position where a curvature of the front-edge curved portion varies, and the inflection point may be positioned on a position apart from the center of the impeller by 70% to 90% of a length from the center of the impeller to the outer peripheral portion of the blade portion.

An inclined angle of the front-edge curved portion in a direction of the impeller center with respect to the inflection point may be in a range of −5° to +5°, and an inclined angle of the front-edge curved portion in a direction of the outer peripheral portion of the impeller with respect to the inflection point may be in a range of +15° to +30°.

This reversible flow fan may further include: rear-edge curved portions disposed on surfaces on rear edge sides of the blade portions in the normal rotation direction of the impeller. The rear-edge curved portions are convexly curved from the center of the impeller toward the directions of outer peripheral portions of the blade portions in the airflow directions during the reverse rotation of the impeller.

With the reversible flow fan according to the above aspects of this disclosure, the noise characteristics during the reverse rotation ensure being reduced. The noise characteristics during the normal rotation and the noise characteristics during the reverse rotation ensure being made close to one another.

In the reversible flow fan, during the reverse rotation, a spoke that supports a motor is positioned on a suction side of a vane. In view of this, during the reverse rotation, a sound pressure level tends to significantly increase compared with during the normal rotation.

Therefore, the reversible flow fan (hereinafter referred to as a "blast fan" according to the embodiment proposes a blade shape of the vane for ensuring the noise reduction during the reverse rotation.

First Embodiment

Figure 2:
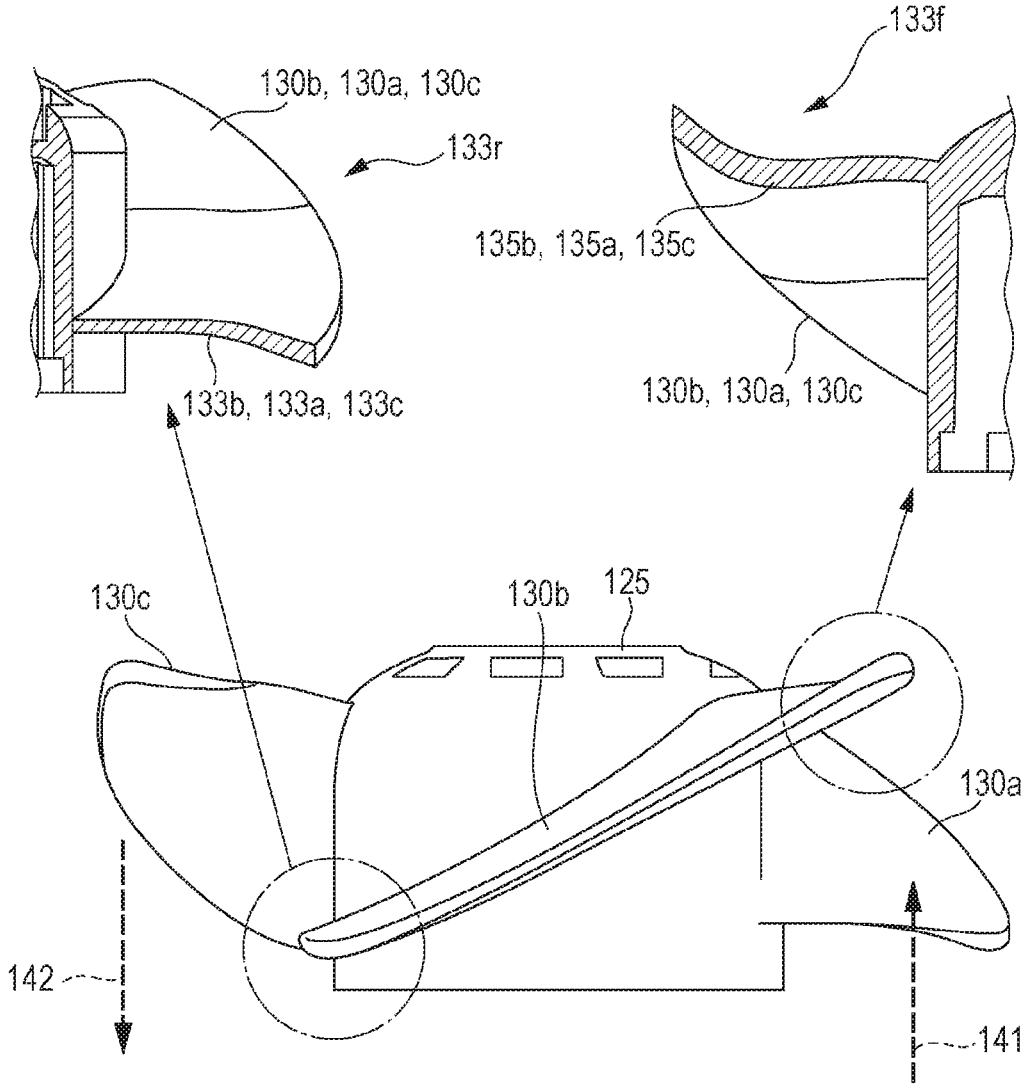
FIG. 2 is a side view illustrating the exemplary configuration of the impeller (the vane) used for the blast fan according to the first embodiment.

FIG. 1 is a front view illustrating an exemplary configuration of an impeller (vane) 120 used for a blast fan according to a first embodiment of this disclosure. FIG. 2 is a side view of the impeller 120. Both FIG. 1 and FIG. 2 are drawings illustrating the blade shapes of the vanes. An arrow 142 indicates a direction of a flow of a fluid (air) during the normal rotation of the impeller 120. An arrow 141 indicates a direction of the flow of the fluid (air) during the reverse rotation of the impeller 120. That is, FIG. 1 and FIG. 2 define the respective portions.

As illustrated in FIG. 1 and FIG. 2, the impeller (the vane) 120 according to the embodiment includes, for example, a blade mounting portion 125, a first blade portion 130*a*, a second blade portion 130*b*, and a third blade portion 130*c*. The blade mounting portion 125 houses a motor (not illustrated). Furthermore, to the blade mounting portion 125, a blade (the first blade portion 130*a*, the second blade portion 130*b* and the third blade portion 130*c*) is mounted. The first blade portion 130*a*, the second blade portion 130*b*, and the third blade portion 130*c* are disposed (mounted) on a side surface of the blade mounting portion 125. An arrow 170 indicates a reverse rotation direction of the impeller 120.

Figure 3:
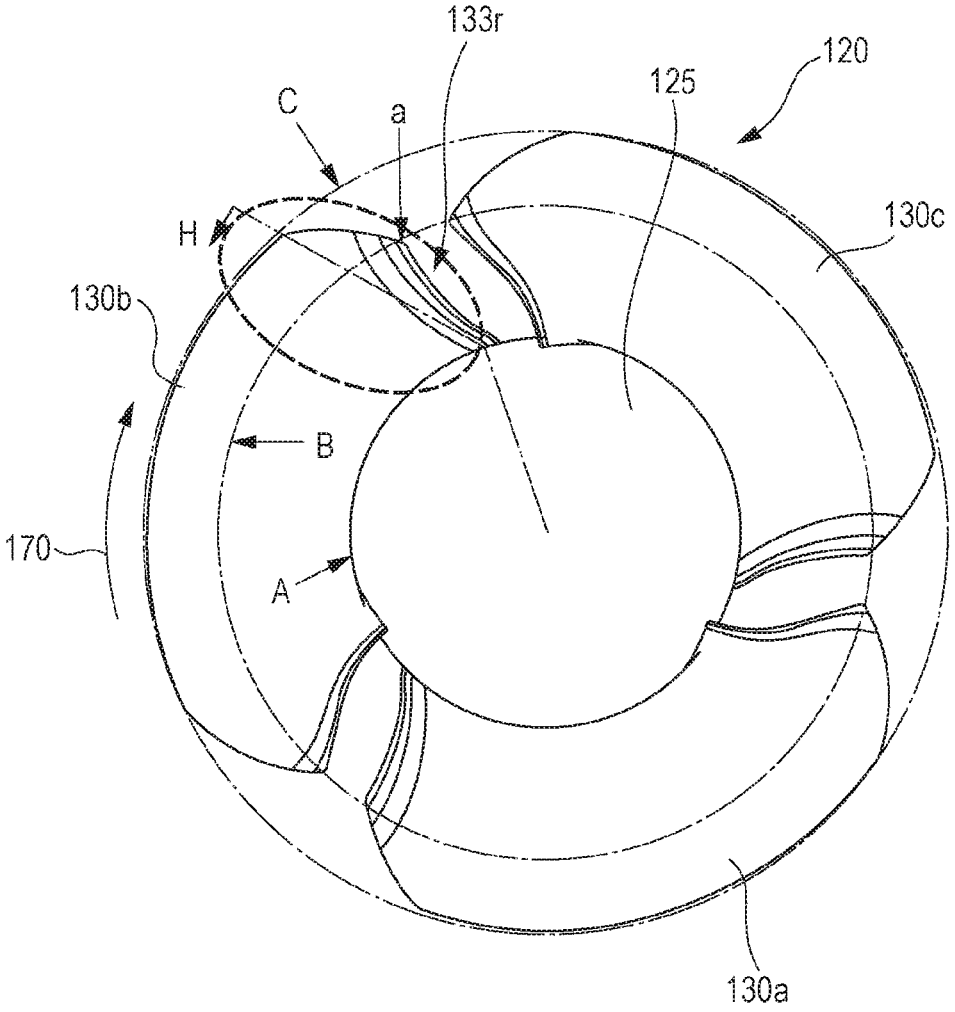
FIG. 3 is a front view corresponding to FIG. 1.
Figure 4:
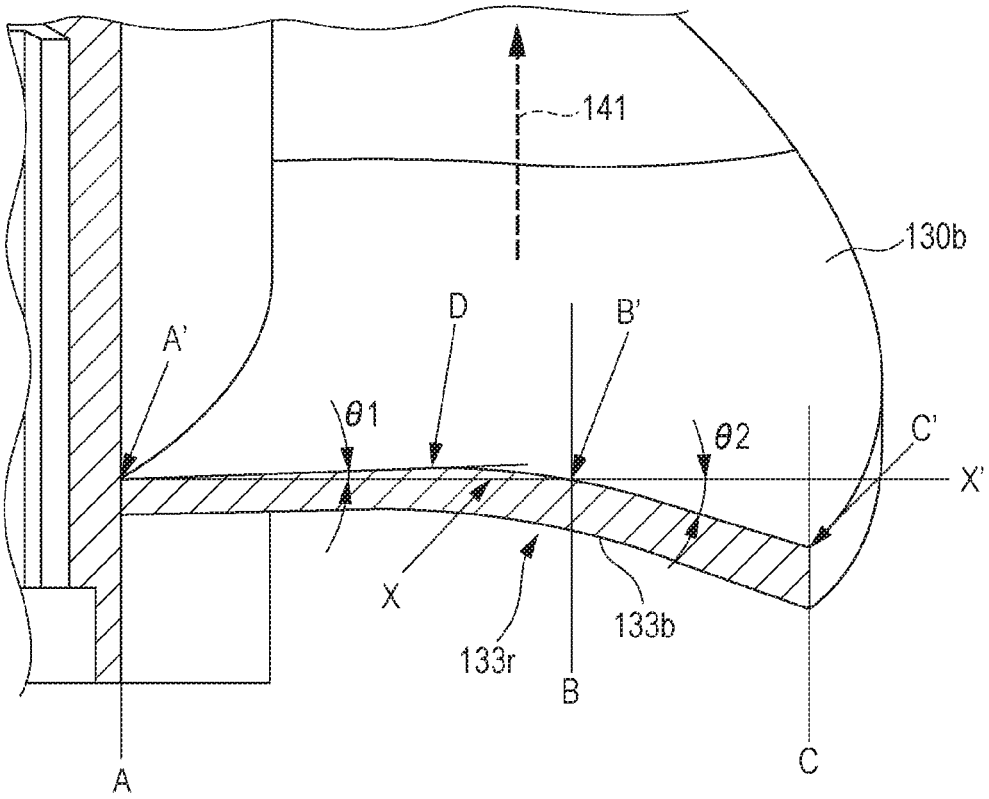
FIG. 4 is a drawing for describing a shape of a rear-edge curved portion of a rear edge of a second blade portion in more detail, and a drawing illustrating near a dotted line in FIG. 3 including a cross section viewed from an arrow H direction.

FIG. 3 is a drawing corresponding to FIG. 1. FIG. 4 illustrates an exemplary shape of a rear edge 133*r* of the second blade portion 130*b* in more detail. That is, FIG. 4 is a drawing illustrating near a dotted line in FIG. 3 including a cross section viewed from an arrow H direction. The first blade portion 130*a* and the third blade portion 130*c* have configurations similar to the second blade portion 130*b*.

FIG. 3 illustrates the entire impeller (the vane) 120 from a top. As illustrated in FIG. 3, the second blade portion 130*b* has a circumferential apex a on a rear edge side (133*r*), the circumferential apex a is positioned on a reference line B. The reference line B passes through, for example, a middle between a blade outer peripheral portion C of the second blade portion 130*b* and a portion (a blade inner peripheral portion A of the second blade portion 130*b*) of the blade mounting portion 125 contacting the second blade portion 130*b*. The blade outer peripheral portion C, the reference line B, and the blade inner peripheral portion A are positioned, for example, on a blade surface of a cross section of the second blade portion 130*b*.

The reference line B is positioned on a position, for example, apart from a center of the impeller 120 by 70% to 90% of a length from the center of the impeller 120 to the blade outer peripheral portion C.

FIG. 4 illustrates a cross section near a rear edge in the normal rotation direction of the second blade portion 130*b*. As illustrated in FIG. 4, the second blade portion 130*b* has a convex shape (a convex surface) on a blade surface as a surface on a negative pressure side during the reverse rotation.

A position A' illustrated in FIG. 4 is, for example, an intersection point of the cross section of the second blade portion 130*b* with the blade inner peripheral portion (a position of a blade base) A. A position B' illustrated in FIG. 4 is, for example, an intersection point of the cross section of the second blade portion 130*b* with the reference line B. A position C' illustrated in FIG. 4 is, for example, an intersection point of the cross section of the second blade portion 130*b* with the blade outer peripheral portion C.

Assume that a position where a displacement is maximum between the position A' and the position B' is a position D. An angle θ1 between a reference line connecting the position A' to the position D and a reference line X extending from the position A' in a direction perpendicular to a direction of a rotation axis of the impeller 120 is, for example, between −5° and +5°. That is, an inclined angle of a rear-edge curved portion (described below) in a center direction of the impeller 120 with respect to a first inflection point (described below) may be in a range of −5° to +5°.

On the other hand, an angle (θ2) between a reference line connecting the position B' to the position C' and a reference line X' extending from the position B' in the direction perpendicular to the direction of the rotation axis of the impeller 120 is, for example, between 15° and 30°. Here, the circumferential apex a (see FIG. 3) on the reference line B as a position where a curvature of the blade surface significantly varies is referred to as a rear-edge inflection point (a first inflection point). That is, an inclined angle of the rear-edge curved portion (described below) in a direction of the outer peripheral portion of the impeller 120 with respect to the first inflection point may be in a range of +15° to +30°.

With the above configuration, the rear edge 133*r* (the surface on the rear edge side) in the normal rotation direction of the second blade portion 130*b* of the impeller (the vane) 120 includes a rear-edge curved portion (a first curved portion (curved surface)) 133*b*. The first blade portion 130*a* and the third blade portion 130*c* have similar configurations. That is, a rear edge (a surface on a rear edge side) in the normal rotation direction of the first blade portion 130*a* includes a rear-edge curved portion (a first curved portion) 133*a*. A rear edge (a surface on a rear edge side) in the normal rotation direction of the third blade portion 130*c* includes a rear-edge curved portion (a first curved portion) 133*c*.

Thus, the first to the third blade portions 130*a* to 130*c* of the impeller (the vane) 120 include convexly curved portions (the rear-edge curved portions 133*a* to 133*c*) on the rear edge sides in the normal rotation direction of the impeller 120. The rear-edge curved portions 133*a* to 133*c* are convexly curved from the center of the impeller (the vane) toward the directions of the outer peripheral portions of the first to the third blade portions 130*a* to 130*c* in an airflow direction during the reverse rotation (in an airflow direction in the reverse rotation direction) of the impeller 120. The rear-edge curved portions 133*a* to 133*c* are disposed to reduce a noise in the case of the reverse rotation of the impeller (the vane) 120. The rear-edge curved portions 133*a* to 133*c* have curved heights (dimensions of convex) of, for example, 1.6 mm.

Figure 5:
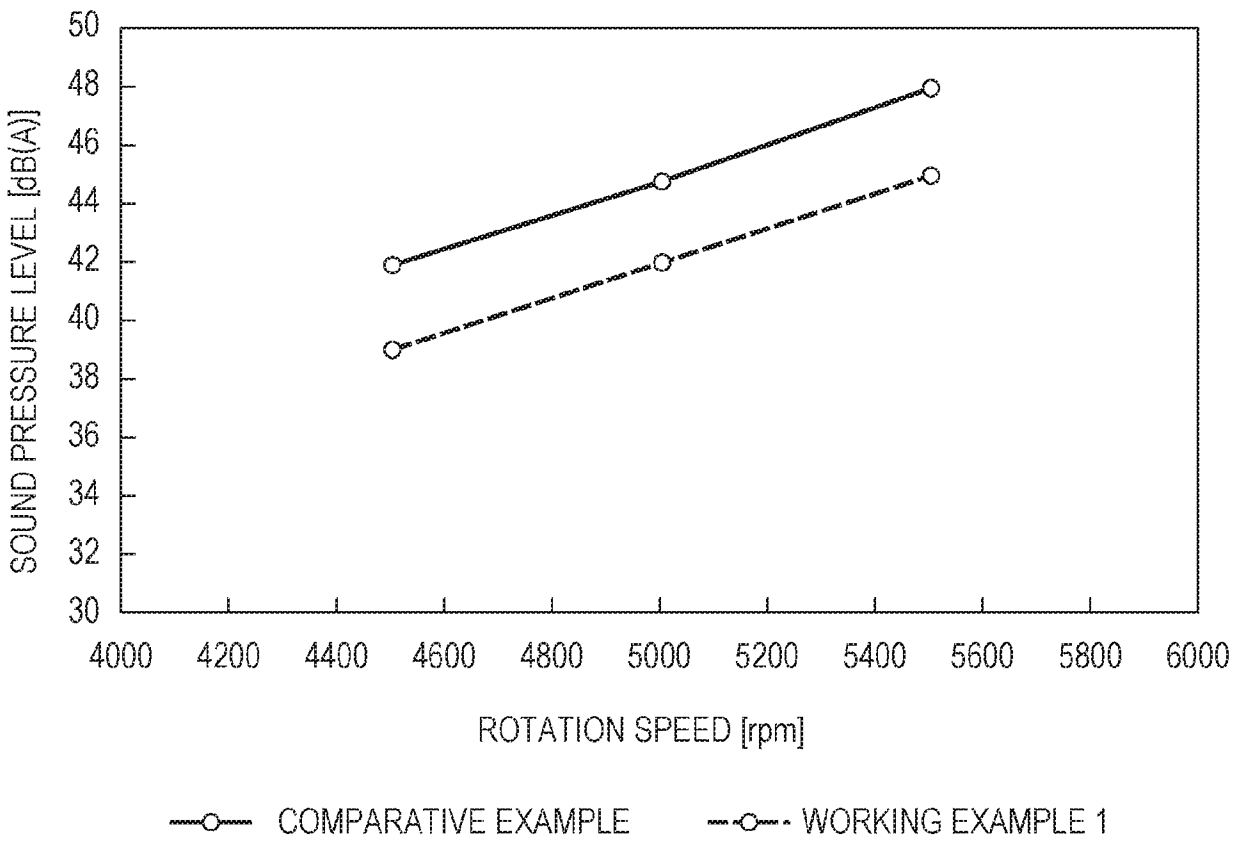
FIG. 5 is a drawing indicating a relation between a rotation speed of a blast fan and a sound pressure level when a rear-edge curved portion is disposed on a rear edge of a blade portion, and a drawing comparing a blast fan (a comparative example) without the rear-edge curved portion with a blast fan with the rear-edge curved portion according to the first embodiment.

FIG. 5 indicates a relation between a rotation speed of a blast fan and a sound pressure level when the rear-edge curved portions 133*a*, 133*b*, and 133*c* are disposed on the first to the third blade portions 130*a*, 130*b*, and 130*c* of the impeller (the vane) 120 respectively. FIG. 5 indicates a comparison of a blast fan (a comparative example) without the rear-edge curved portion with a blast fan (a working example 1) with the rear-edge curved portions 133*a* to 133*c* according to the embodiment. As illustrated in FIG. 5, it is found that the rear-edge curved portions disposed on the first to the third blade portions 130*a* to 130*c* of the impeller (the vane) 120 reduce the sound pressure level during the reverse rotation by approximately 3 dB.

Second Embodiment

A description will be given of a second embodiment of this disclosure. An underlying configuration of the blast fan is similar to the first embodiment. Like reference numerals designate substantially identical configurations, positions, and the like to those of the above-described first embodiment, and therefore descriptions will be omitted in some cases.

Figure 6:
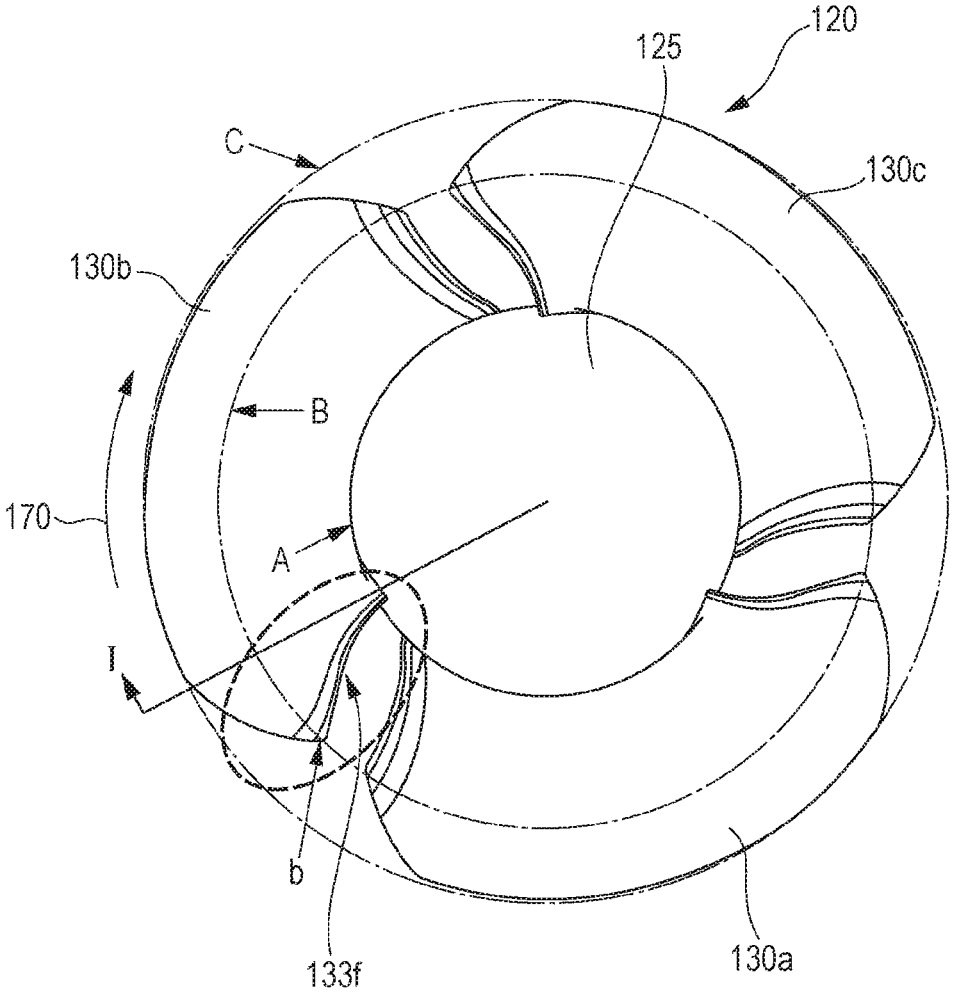
FIG. 6 is a front view illustrating an exemplary configuration of an impeller (vane) used for a blast fan according to a second embodiment of this disclosure, and a drawing corresponding to FIG. 3 in the first embodiment.
Figure 7:
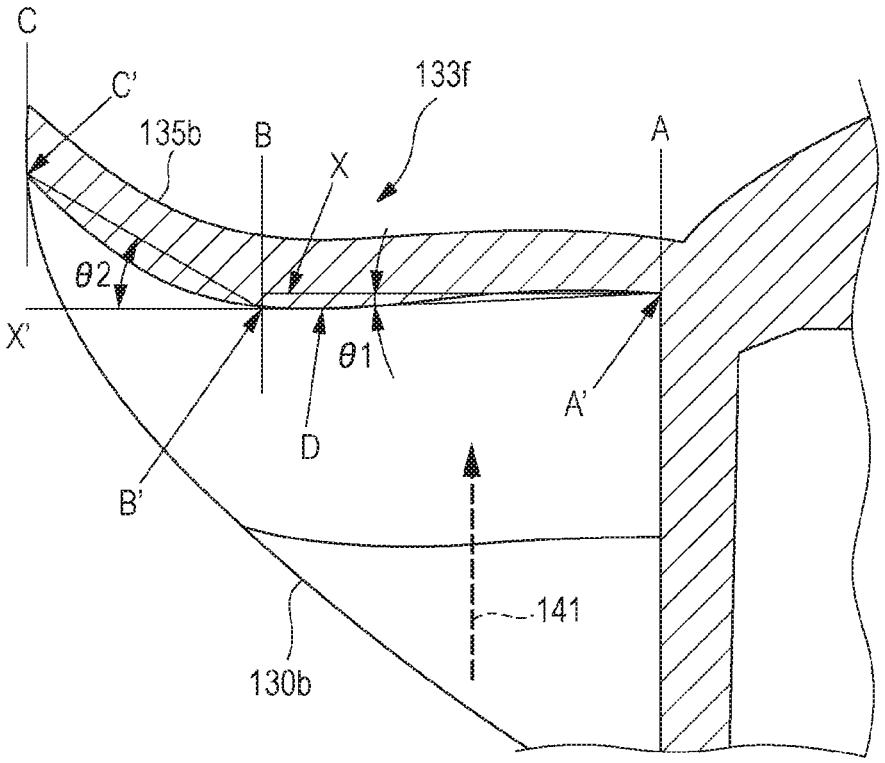
FIG. 7 is a drawing illustrating the exemplary configuration of the impeller (the vane) used for the blast fan according to the second embodiment of this disclosure, a drawing illustrating near a dotted line in FIG. 6 including a cross section viewed from an arrow I direction, and a drawing corresponding to FIG. 4 in the first embodiment.

FIG. 6 is a drawing corresponding to FIG. 3 in the first embodiment. FIG. 7 is a drawing corresponding to FIG. 4 in the first embodiment.

In the first embodiment, the rear-edge curved portion 133*b* is disposed on the rear edge 133*r* in the normal rotation direction of the second blade portion 130*b*. Instead of the rear-edge curved portion 133*b*, in this embodiment, a front-edge curved portion (a second curved portion) 135*b* is disposed on a front edge 133*f* (a surface on a front edge side) in the normal rotation direction of the second blade portion 130*b*. The first blade portion 130*a* and the third blade portion 130*c* have similar configurations. That is, a front-edge curved portion (a second curved portion) 135*a* is disposed on a front edge (a surface on a front edge) in the normal rotation direction of the first blade portion 130*a*. A front-edge curved portion (a second curved portion) 135*c* is disposed on a front edge (a surface on a front edge) in the normal rotation direction of the third blade portion 130*c*.

FIG. 7 illustrates a shape of the front edge 133*f* of the second blade portion 130*b* in more detail as an example. Then, FIG. 7 is a drawing illustrating near a dotted line in FIG. 6 including a cross section viewed from an arrow I direction.

FIG. 6 illustrates the entire impeller 120 from a top. As illustrated in FIG. 6, the second blade portion 130*b* has a circumferential apex b on a front edge side positioned on a reference line B. The reference line B passes through, for example, a middle between a blade outer peripheral portion C of the second blade portion 130*b* and a portion (a blade inner peripheral portion A of the second blade portion 130*b*) of the blade mounting portion 125 contacting the second blade portion 130*b*.

The reference line B is positioned on a position, for example, apart from a center of the impeller 120 by 70% to 90% of a length from the center of the impeller 120 to the blade outer peripheral portion C.

FIG. 7 illustrates a cross section near a front edge in the normal rotation direction of the second blade portion 130*b*. As illustrated in FIG. 7, the second blade portion 130*b* has a depressed shape (a depressed surface) on a blade surface as a surface on a negative pressure side during the reverse rotation.

Assume that a position where a displacement is maximum between a position A' and a position B' is a position D. An angle θ1 between a reference line connecting the position A' to the position D and a reference line X extending from the position A' in a direction perpendicular to a direction of a rotation axis of the impeller 120 is, for example, between −5° and +5°. That is, an inclined angle of a front-edge curved portion (described below) in a center direction of the impeller 120 with respect to a second inflection point (described below) may be in a range of −5° to +5°.

On the other hand, an angle (θ2) between a reference line connecting the position B' to a position C' and a reference line X' extending from the position B' in the direction perpendicular to the direction of the rotation axis of the impeller 120 is, for example, between 15° and 30°. Here, the circumferential apex b on the reference line B as a position where a curvature of the blade surface significantly varies is referred to as a front-edge inflection point (a second inflection point). That is, an inclined angle of the front-edge curved portion (described below) in a direction of the outer peripheral portion of the impeller 120 with respect to the second inflection point may be in a range of +15° to +30°.

With the above configuration, the front edge side (133*f*) in the normal rotation direction of the second blade portion 130*b* of the impeller (the vane) 120 includes a front-edge curved portion (a second curved portion (curved surface)) 135*b*. Similarly, the first blade portion 130*a* has a front edge side in the normal rotation direction where a front-edge curved portion (a second curved portion (curved surface)) 135*a* is disposed, and the third blade portion 130*c* has a front edge side in the normal rotation where a front-edge curved portion (a second curved portion (curved surface)) 135*c* is disposed.

Thus, the first to the third blade portions 130*a* to 130*c* of the impeller (the vane) 120 include concavely curved portions (the front-edge curved portions 135*a* to 135*c*) on the front edge sides in the normal rotation direction of the impeller 120. The front-edge curved portions 135*a* to 135*c* are concavely curved from the center of the impeller (the vane) toward the directions of the outer peripheral portions of the first to the third blade portions 130*a* to 130*c* in an airflow direction during the reverse rotation (in an airflow direction in the reverse rotation direction) of the impeller 120. The front-edge curved portions 135*a* to 135*c* are disposed to reduce a noise in the case of the reverse rotation of the impeller (the vane) 120. The front-edge curved portions 135*a* to 135*c* have curved heights (dimensions of concave) of, for example, 2.2 mm.

Figure 8:
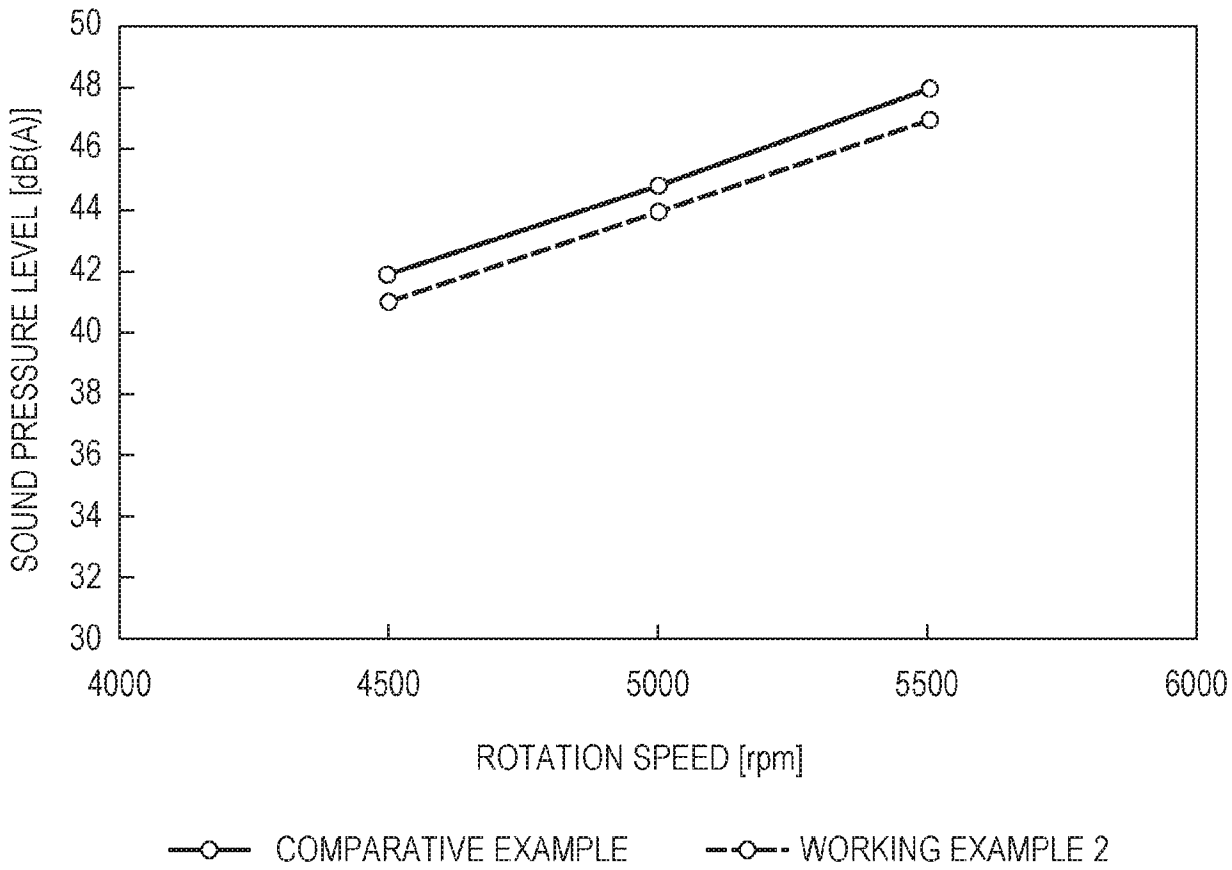
FIG. 8 is a drawing indicating a relation between a rotation speed of a blast fan and a sound pressure level when a front-edge curved portion is disposed on a front edge of a blade portion, and a drawing comparing a blast fan (a comparative example) without the front-edge curved portion with a blast fan with the front-edge curved portion according to the second embodiment.

FIG. 8 indicates a relation between a rotation speed of a blast fan and a sound pressure level when the front-edge curved portions 135*a*, 135*b*, and 135*c* are disposed on the first to the third blade portions 130*a*, 130*b*, and 130*c* of the impeller (the vane) 120 respectively. FIG. 8 indicates a comparison of a blast fan (a comparative example) without the front-edge curved portion with a blast fan (a working example 2) with the front-edge curved portions 135*a* to 135*c* according to the embodiment. As illustrated in FIG. 8, it is found that the front-edge curved portions disposed on the first to the third blade portions 130*a* to 130*c* of the impeller (the vane) 120 reduce the sound pressure level during the reverse rotation by approximately 1 dB.

Third Embodiment

A description will be given of a third embodiment of this disclosure. An underlying configuration of the blast fan is similar to the first embodiment and the second embodiment. Like reference numerals designate substantially identical configurations, positions, and the like to those of the above-described first and second embodiments, and therefore descriptions will be omitted in some cases.

In an impeller 120 according to the third embodiment, the first to the third blade portions 130*a* to 130*c* include both the rear-edge curved portions (see FIG. 3 and FIG. 4) indicated in the first embodiment and the front-edge curved portions (see FIG. 6 and FIG. 7) indicated in the second embodiment.

Figure 9:
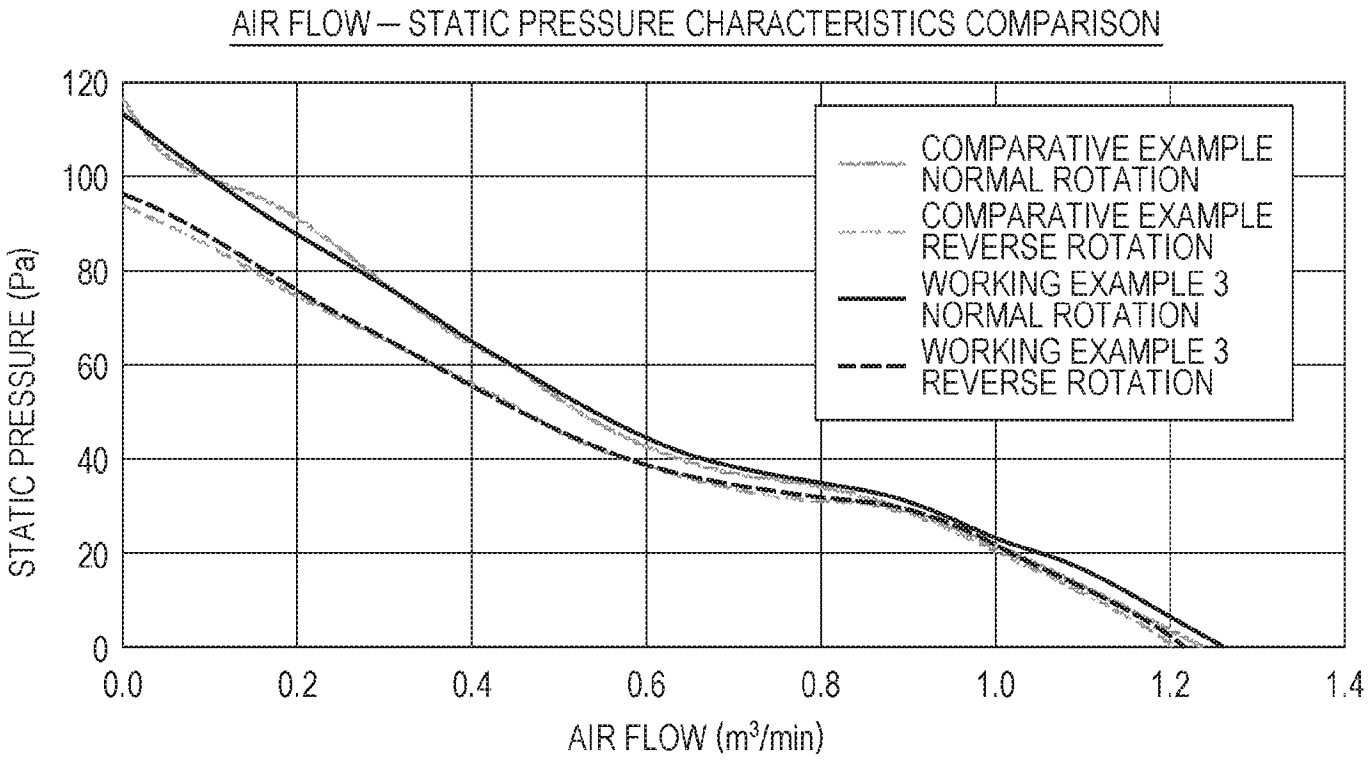
FIG. 9 is a drawing indicating air flow-static pressure characteristics of a blast fan according to a third embodiment of this disclosure and a blast fan (a comparative example) without any of the rear-edge curved portion and the front-edge curved portion.

FIG. 9 is a drawing indicating air flow-static pressure characteristics of a blast fan (a working example 3) according to the third embodiment and a blast fan (a comparative example) without any of the rear-edge curved portion and the front-edge curved portion.

As illustrated in FIG. 9, the working example 3 and the comparative example have similar air flow-static pressure characteristics. This confirms that whether or not the rear-edge curved portion and the front-edge curved portion are disposed is less likely to make a difference on the air flow-static pressure characteristics. That is, disposing the rear-edge curved portion and the front-edge curved portion causes almost no change on blowing characteristics of the blast fan.

TABLE 1

| | Comparative Example | Working Example 3 |
|---|---|---|
| During Normal Rotation | 39 dB | 39 dB |
| During Reverse Rotation | 47 dB | 43 dB |

Figure 10:
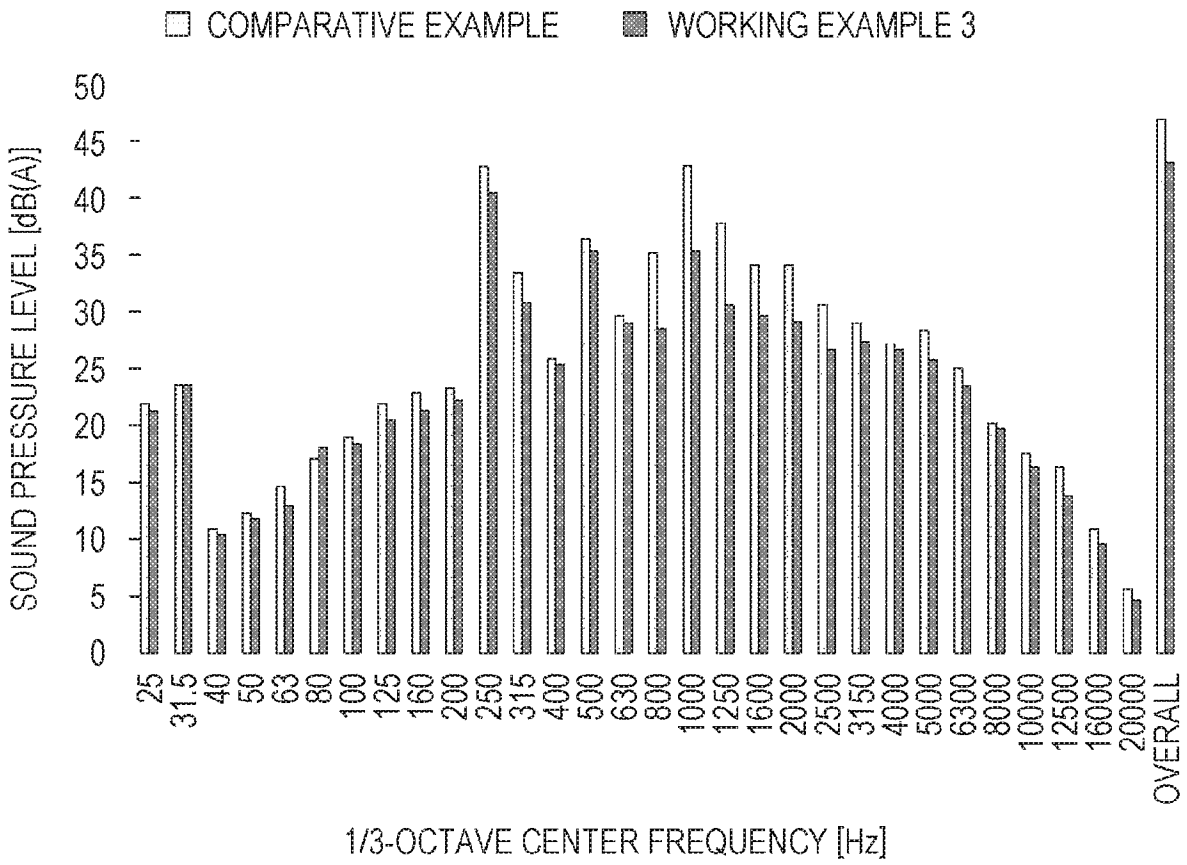
FIG. 10 is a drawing indicating a comparison result of frequency characteristics during a reverse rotation between the blast fan according to the third embodiment of this disclosure and the blast fan (the comparative example) without any of the rear-edge curved portion and the front-edge curved portion.

Table 1 indicates sound pressure level characteristics of the working example 3 and the comparative example. FIG. 10 indicates a comparison result of frequency characteristics during the reverse rotation between the working example 3 and the comparative example. Table 1 indicates that disposing the rear-edge curved portion and the front-edge curved portion decreases the sound pressure level during the reverse rotation from 47 dB to 43 dB by approximately 4 dB.

Table 1 and FIG. 10 indicate that the sound pressure levels of frequency components caused by the vane during the reverse rotation ensure being reduced.

As described above, according to the embodiment, the difference of the sound pressure level between during the normal rotation and during the reverse rotation ensures being decreased. While the difference of the sound pressure level is great at 8 dB(A) in the comparative example, the difference of the sound pressure level ensures being decreased to 4 dB(A) with the embodiment. That is, according to the embodiment, the noise characteristics during the normal rotation and the noise characteristics during the reverse rotation ensure being made equivalent.

In the above embodiments, this disclosure is not limited to the configurations or the like illustrated in the attached drawings. These configurations can be appropriately modified within a range of the advantageous effects of this disclosure to be provided. The above embodiments can be appropriately modified without departing from the spirit of the disclosure.

For example, the shape of the curved portion may be a continuous inclined shape.

The respective components of this disclosure may be arbitrarily selected. An aspect that includes the selected components is included within the technical scope of this disclosure.

The embodiments of this disclosure are applicable to a reversible blower fan.

FIG. 4 is also a drawing illustrating a cross section H in FIG. 3 for describing the shape of the rear edge 133*r* of the second blade portion 130*b* as an example in more detail. FIG. 4 (the cross section in FIG. 3) H also illustrates the convex shape (the convex surface) of the blade surface that is on the negative pressure side during the reverse rotation. FIG. 7 is also a drawing illustrating a cross section I in FIG. 6 for describing the shape of the front edge 133*f* of the second blade portion 130*b* as an example in more detail. The cross section I in FIG. 7 also illustrates the concave of the blade surface that is on the negative pressure side during the reverse rotation.

In the case of FIG. 3 illustrating the entire impeller (the vane) 120 viewed from a top, the circumferential apex a of the rear edge side (133*r*) of the blade 130*b* may be positioned on the reference line B passing through the middle between the blade outer peripheral portion C and the blade mounting portion A. In the case of FIG. 6 illustrating the entire impeller 120 viewed from a top, the circumferential apex b of the front edge side of the blade 130*b* may be positioned on the reference line B passing through the middle between the blade outer peripheral portion C and the blade mounting portion A.

The reference line B may be positioned at the position between 70% and 90% of a diameter of the blade outer peripheral portion from the center of the impeller 120. Assume that a position where a displacement is maximum between A and B is D, and the angle θ1 between the reference line connecting the blade base A' to the D and the reference line X extending perpendicular from A' may be between −5° and +5°. On the other hand, the angle between the reference line connecting B' to C' and the reference line X' extending perpendicular from B' may be between 15° and 30°.

On the rear edge side (133*r*) in the reverse rotation direction of the impeller (the vane) 120, the rear-edge curved portion (the first curved portion (curved surface)) 133*b* (similarly, 133*a* and 133*c*) may be disposed.

The inflection point (the first inflection point) of the rear edge may be the circumferential apex a on the position B where the curvature of the blade surface significantly varies. The inflection point (the second inflection point) of the front edge may be the circumferential apex b on the position B where the curvature significantly varies.

The reversible flow fan according to the embodiment may be the following first to seventh reversible flow fans.

The first reversible flow fan includes a rear-edge curved portion (a first curved portion, a curved surface, and an inclined surface) disposed on a surface. The surface is disposed on a rear edge side of an impeller in a normal rotation direction of the impeller (a vane). The rear-edge curved portion is convexly curved from a center of the impeller (the vane) toward a direction of a blade outer peripheral portion in an airflow direction in a reverse rotation direction.

In the second reversible flow fan according to the first reversible flow fan, an inflection point of a rear edge as a position where a curvature of the rear-edge curved portion varies is positioned at between 70% and 90% of a diameter of the blade outer peripheral portion from the center of the impeller.

In the third reversible flow fan according to the second reversible flow fan, an inclined angle in a direction of the center of the impeller with respect to the inflection point of the rear edge is −5° to +5°. An inclined angle in a direction of the outer peripheral portion of the impeller with respect to the inflection point of the rear edge is +15° to +30°.

The fourth reversible flow fan includes a front-edge curved portion (a second curved portion, a curved surface, and an inclined surface) disposed on a surface. The surface is disposed on a front edge side of an impeller in a normal rotation direction of the impeller (vane). The front-edge curved portion is concavely curved from a center of the impeller (vane) toward a direction of a blade outer peripheral portion in an airflow direction in a reverse rotation direction.

In the fifth reversible flow fan according to the fourth reversible flow fan, an inflection point of a front edge as a position where a curvature of the front-edge curved portion varies is positioned at between 70% and 90% of a diameter of the blade outer peripheral portion from the center of the impeller.

The sixth reversible flow fan is the fifth reversible flow fan, and the inclined angle in the impeller center direction with respect to the inflection point of the front edge is −5° to +5°, and the inclined angle in the impeller outer peripheral portion direction with respect to the inflection point of the front edge is +15° to +30°.

The seventh reversible flow fan includes a rear-edge curved portion and a front-edge curved portion. The rear-edge curved portion is disposed on a surface. The surface is disposed on a rear edge side of an impeller (vane) in a normal rotation direction of the impeller (vane). The rear-edge curved portion is convexly curved from a center of the impeller (vane) toward a direction of a blade outer peripheral portion in an airflow direction in a reverse rotation direction. The front-edge curved portion is disposed on a surface. The surface is disposed on a front edge side of the impeller (vane) in the normal rotation direction of the impeller (vane). The front-edge curved portion is concavely curved from the center of the impeller (vane) toward the direction of the blade outer peripheral portion in the airflow direction in the reverse rotation direction.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A reversible flow fan comprising:

an impeller that includes blade portions; and a set of curved portions disposed on surfaces on either one of rear or front edge sides of each of the blade portions in a rotation direction of the impeller, wherein each of the curved portions is convexly curved from a center of the impeller toward directions of outer peripheral portions of the blade portions in airflow directions during a rotation of the impeller, the curved portion has an inflection point as a position where a curvature of the curved portion varies, the inflection point is positioned on a position apart from the center of the impeller by 70% to 90% of a length from the center of the impeller to the outer peripheral portion of the blade portion, an inclined angle of the curved portion in a direction of the impeller center with respect to the inflection point is in a range of −5° to +5°, and an inclined angle of the curved portion in a direction of the outer peripheral portion of the impeller with respect to the inflection point is in a range of +15° to +30°.

2. The reversible flow fan according to claim 1, wherein each of the curved portions is disposed on surfaces on the rear edge sides of the blade portions in the rotation direction of the impeller.

3. The reversible flow fan according to claim 1, wherein each of the curved portions is disposed on surfaces on the front edge sides of the blade portions in the rotation direction of the impeller.

4. The reversible flow fan according to claim 3, further comprising:

rear-edge curved portions disposed on surfaces on rear edge sides of the blade portions in the rotation direction of the impeller, wherein the rear-edge curved portions are convexly curved from the center of the impeller toward the directions of outer peripheral portions of the blade portions in the airflow directions during the reverse rotation of the impeller.

* * * * *